US006701737B2

(12) United States Patent
Ohama et al.

(10) Patent No.: US 6,701,737 B2
(45) Date of Patent: Mar. 9, 2004

(54) INTEGRAL-TYPE AIR CONDITIONER

(75) Inventors: Yasunori Ohama, Gunma (JP); Takuya Kajita, Tochigi (JP); Akira Okada, Tochigi (JP); Tetsushi Yamashita, Tochigi (JP); Kiyoshi Kobayashi, Tochigi (JP)

(73) Assignees: Sanyo Electric Co., Ltd., Osaka (JP); Sanyo Electric Air Conditioning, Tochigi (JP)

( * ) Notice: Subject to any disclaimer, the term of this patent is extended or adjusted under 35 U.S.C. 154(b) by 0 days.

(21) Appl. No.: 10/214,281

(22) Filed: Aug. 6, 2002

(65) Prior Publication Data

US 2003/0029183 A1 Feb. 13, 2003

(30) Foreign Application Priority Data

Aug. 10, 2001 (JP) ..... 2001-243581
Sep. 5, 2001 (JP) ..... 2001-268587

(51) Int. Cl.[7] ..... F25D 23/12; F25D 21/14
(52) U.S. Cl. ..... 62/262; 62/285
(58) Field of Search ..... 62/262, 285, 263, 62/288, 289, 291, 259.1

(56) References Cited

U.S. PATENT DOCUMENTS 5,085,057 A * 2/1992 Thompson et al. ..... 62/262
5,437,164 A * 8/1995 Consiglio ..... 62/259.1

FOREIGN PATENT DOCUMENTS

JP 01075826 * 3/1989 ..... F24F/1/02

* cited by examiner

*Primary Examiner*—Chen Wen Jiang
(74) *Attorney, Agent, or Firm*—Darby & Darby

(57) ABSTRACT

In an air conditioner including an indoor heat exchanger and an indoor fan which are disposed in an indoor-side chamber, and an outdoor heat exchanger and an outdoor fan which are disposed in an outdoor-side chamber, the indoor-side chamber and the outdoor-side chamber being partitioned by a partition plate mounted on a bottom plate, the outdoor heat exchanger is disposed on said bottom plate, and the bottom plate is integrally formed with a dam member for damming up drain water flowing from at least one of the indoor heat exchanger and the outdoor heat exchanger. Further, a drain pan on which the indoor heat exchanger is mounted is disposed on the bottom plate, the partition plate is equipped with a drain opening through which drain water flowing from the indoor heat exchanger through the drain pan is flows to the bottom plate, and at least one of the drain pan and the partition plate is equipped with an intercepting member for intercepting flow of rain/wind from the outdoor-side chamber to the indoor-side chamber.

10 Claims, 9 Drawing Sheets

INTEGRAL-TYPE AIR CONDITIONER

BACKGROUND OF THE INVENTION

1. Field of the Invention

The present invention relates to an integral-type air conditioner in which an indoor heat exchanger, an indoor fan, an outdoor heat exchanger and an outdoor fan are integrally fabricated, and particularly to an integral-type air conditioner having an improvement in the structure of a bottom plate 2. Description of the Related Art There has been known an integral-type air conditioner in which an indoor heat exchanger, an indoor fan, an outdoor heat exchanger and an outdoor fan are integrally fabricated and also an indoor side chamber having the indoor heat exchanger and the indoor fan arranged therein and the inside of the air conditioner is partitioned into an outdoor side chamber having the outdoor heat exchanger and the outdoor fan arranged therein by a partition plate.

In the air conditioner as described above, a drain pan on which the indoor heat exchanger is mounted is disposed in the indoor-side chamber. The drain pan is mounted on a bottom plate on which the partition plate is fixedly mounted so as to be erected.

In such an air conditioner, drain water generated by the indoor heat exchanger functioning as an evaporator under cooling operation passes through the drain pan, and then it is guided through a drain opening formed in the partition plate to the bottom plate. The drain water thus guided to the bottom plate is discharged to the outside, or it is stocked on the bottom plate and drained up by rotation of a slinger ring of the outdoor fan to scatter the drain water to the outdoor heat exchanger functioning as a condenser, thereby enhancing the condensation capability of the condenser.

In the case where the drain water is stocked on the bottom plate as described above, a dam member is mounted on the bottom plate. Further, the dam member has also a function of preventing drain water generated by the outdoor heat exchanger from invading into the inside of the dam member. Therefore, there can be avoided such a problem that the drain water thus invading is frozen and collides against the slinger ring. The dam member having the above function as described above has been hitherto formed of a separate part from the bottom plate, and it is fixed to the bottom plate by spot welding or the like and then subjected to a waterproof treatment. Accordingly, the manufacturing cost of the bottom plate rises up.

In the air condition as described above, the outdoor-side chamber intercommunicates with the outside air. Accordingly, for example, there is such a problem that under rainstorm such as hurricane or the like, wind and rain invade into the outdoor-side chamber, pass through the drain opening of the partition plate into the indoor-side chamber and finally invade into the room.

Further, the partition plate is equipped with a fixing flange extending to the indoor-side chamber at the lower end thereof, and the fixing flange portion is fixed to the bottom plate, whereby the partition plate is fixedly mounted on the bottom plate. However, under rainstorm or the like, rain drops which invade into the outdoor-side chamber of the air conditioner and attach to a surface of the partition plate facing the outdoor-side chamber may fall down, pass through the gap between the fixing flange portion of the partition plate and the bottom plate into the indoor-side chamber, and scatter from the indoor-side chamber into the room.

SUMMARY OF THE INVENTION

The present invention has been implemented in view of the foregoing situation, and has an object to provide an integral-type air conditioner for which the manufacturing cost of a bottom plate can be reduced.

The present invention has another object to provide an integral-type air conditioner which can prevent intensive wind and rain from invading into the room.

In order to attain the above objects, according to an aspect of the present invention, there is provided an air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate mounted on a bottom plate, characterized in that the outdoor heat exchanger is disposed on the bottom plate, and the bottom plate is integrally formed with a dam member for damming up drain water flowing from at least one of the indoor heat exchanger and the outdoor heat exchanger.

In the above air conditioner, the dam member is disposed in the neighborhood of the outdoor heat exchanger.

In the above air conditioner, the bottom plate is formed of a drawing member having high malleability, and the dam member is integrally formed on the bottom plate by drawing processing.

In the above air conditioner, the dam member is designed substantially in U-shape so that the center portion thereof extends in the width direction of the bottom plate.

The above air conditioner further comprises a fan casing in which the outdoor fan is accommodated, wherein the dam member is disposed so as to abut against the fan casing.

In order to attain the above objects, there is provided an air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate mounted on a bottom plate, characterized in that a drain pan on which the indoor heat exchanger is mounted is disposed on the bottom plate, the partition plate is equipped with a drain opening through which drain water flowing from the indoor heat exchanger through the drain pan is flows to the bottom plate, and at least one of the drain pan and the partition plate is equipped with an intercepting member for intercepting flow of rain/wind from the outdoor-side chamber to the indoor-side chamber.

In the above air conditioner, the intercepting member is a projecting portion that is erectly equipped on the drain pan so as to face the drain opening.

In the above air conditioner, the intercepting member is a flange portion that is formed at the lower end portion of the partition plate so as to extend to the outdoor-side chamber.

In the above air conditioner, the flange portion is fixed to the bottom plate to thereby fix the partition plate to the bottom plate. 10. The air conditioner as claimed in claim 8, wherein the bottom plate is equipped with a projecting portion extending in the longitudinal direction of the partition plate, and the flange portion of the partition plate is fixed to the projecting portion of the bottom plate while the flange portion extends from the projecting portion to the outdoor-side chamber.

The above air conditioner further comprises an indoor fan casing in which the indoor fan is accommodated, wherein the indoor fan casing is disposed between the indoor fan and the partition plate so that flow of rain/wind from the outdoor-side chamber to the indoor-side chamber is intercepted by the indoor fan casing.

DETAILED DESCRIPTION OF THE PREFERRED EMBODIMENTS

Preferred embodiments according to the present invention will be described hereunder with reference to the accompanying drawings.

Figure 1:
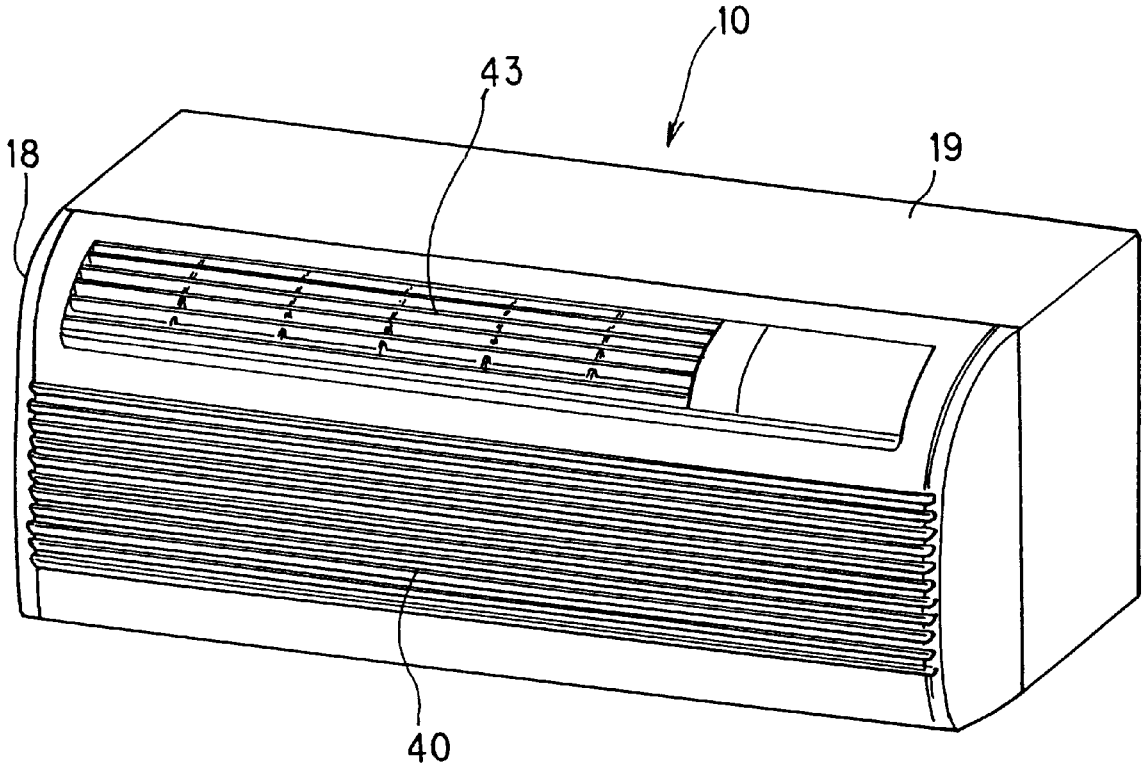
FIG. 1 is a perspective view showing the outlook of an embodiment of an air conditioner according to the present invention.
Figure 2:
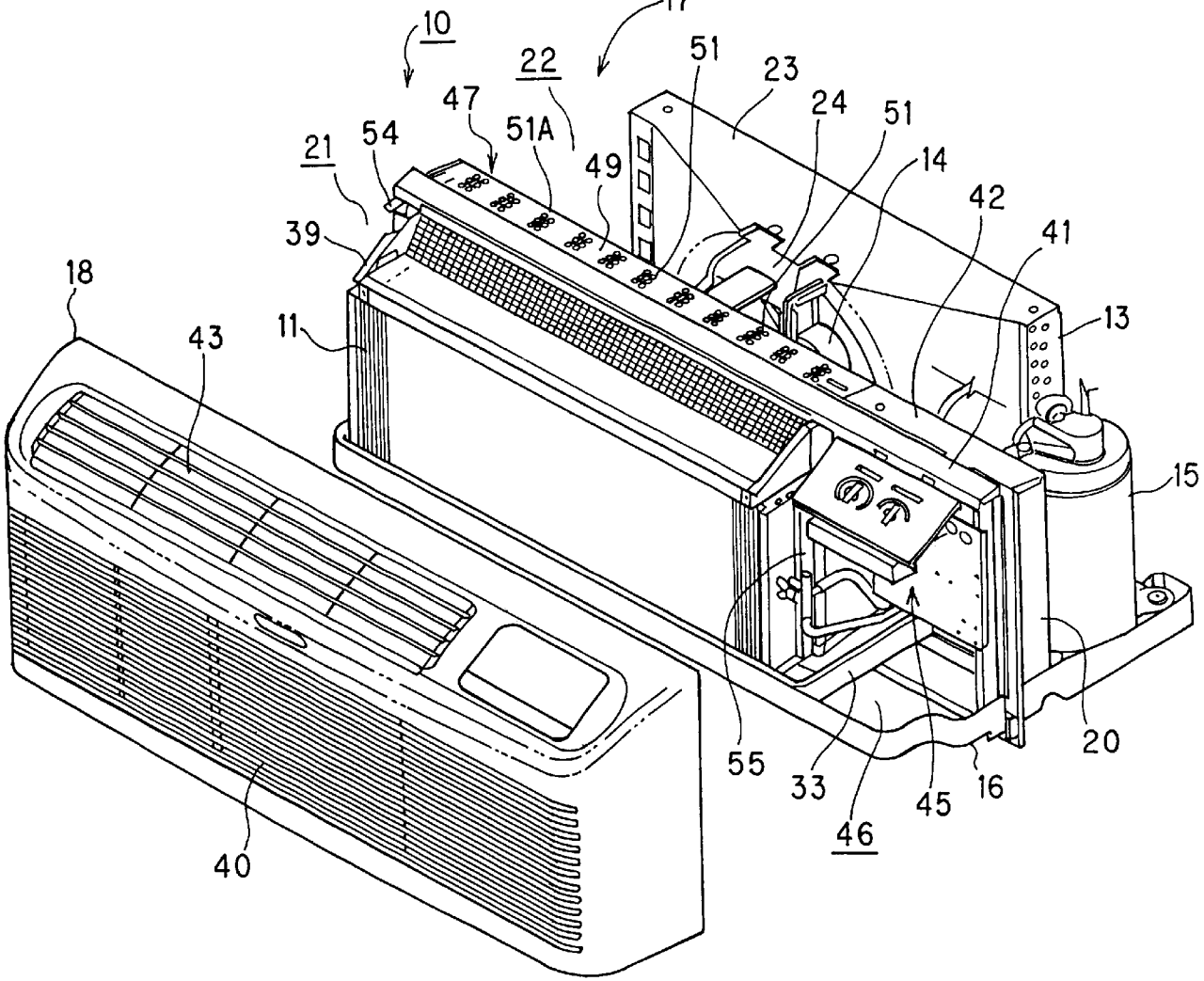
FIG. 2 is an exploded perspective view showing the air conditioner shown in FIG. 1 when a cabinet is omitted.

FIG. 1 is a perspective view showing the outlook of an embodiment of an air conditioner according to the present invention, and FIG. 2 is an exploded perspective view showing the air conditioner of FIG. 1 when a cabinet is omitted from the illustration.

The air conditioner 10 shown in FIGS. 1 and 2 is an integral-type air conditioner which is set up while penetrating through the wall of a building (not shown), and it comprises an indoor heat exchanger 11, a cross-flow fan 12 (FIG. 3) serving as an indoor fan, an outdoor heat exchanger 13, a propeller fan 14 serving as an outdoor fan, a compressor 15, etc. which are integrally fabricated.

The indoor heat exchanger 11, the cross-flow fan 12, the outdoor heat exchanger 13, the propeller fan 14, the compressor 15, etc. are disposed on the bottom plate 16 to constitute the main body 17 of the air conditioner. The front side of the air-conditioner main body 17 (that is, the arrangement side of the indoor heat exchanger 11 and the cross-flow fan 12) is covered by a front panel 18, and the rear side thereof (that is, the arrangement side of the outdoor heat exchanger 13, the propeller fan 14 and the compressor 15) is covered by a cabinet 19. The front panel 18 is located to face the inside of the room of the building. The cabinet 19 is set up in the wall of the building while it penetrates through the wall of the building, and the cabinet 19 is designed to have a sleeve-like shape such as a cylindrical shape, a prismatic shape or the like.

Figure 3:
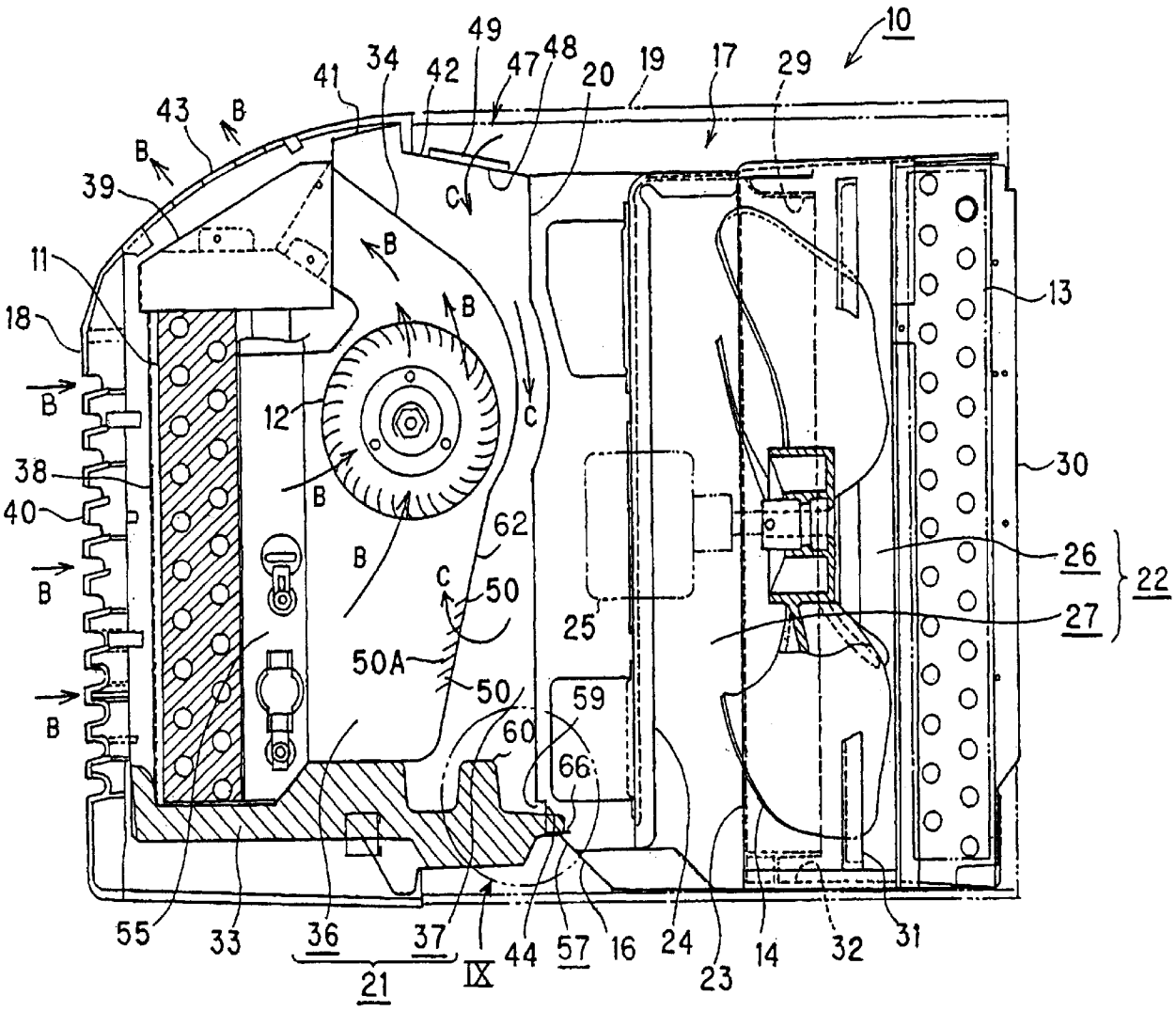
FIG. 3 is a longitudinally-sectional view of the air conditioner shown in FIG. 1.
Figure 4:
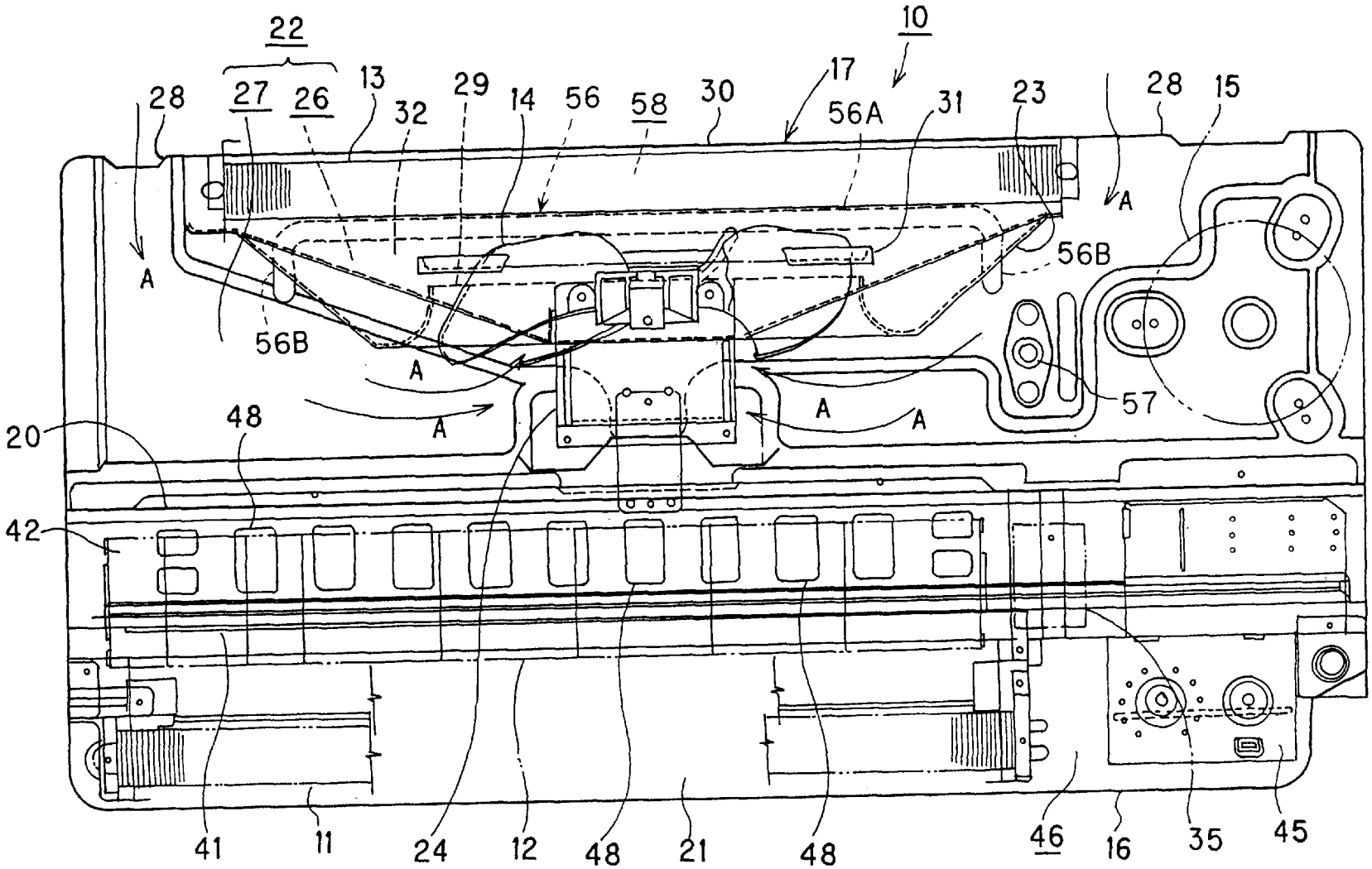
FIG. 4 is a plan view showing the air conditioner shown in FIG. 1 when the cabinet is omitted.

As shown in FIGS. 3 and 4, in the air-conditioner main body 17, a partition plate 20 is erectly equipped at the substantially center position in the front and rear direction of the bottom plate 16 so as to extend in the full-width direction of the bottom plate 16. The partition plate 20 compartments the inside of the air-conditioner main body 17 into an indoor-side chamber 21 in which the indoor heat exchanger 11, the cross-flow fan 12, etc. are arranged and an outdoor-side chamber 22 in which the outdoor heat exchanger 13, the propeller fan 14, the compressor 15, etc. are arranged. Accordingly, the front panel 18 disposed at the front side of the air conditioner 10 covers the indoor-side chamber 21, and the cabinet 19 disposed at the rear side of the air conditioner 10 compartment the surrounding of the outdoor-side chamber 22.

The outdoor heat exchanger 13, an outdoor fan casing 23, a support leg 24 and the compressor 15 are disposed at the outdoor-side chamber side on the bottom plate 16.

The compressor 15 is connected to the outdoor heat exchanger 13, a pressure reducing device (not shown) and the indoor heat exchanger in this order through a refrigerant pipe (not shown), thereby constructing a refrigeration cycle. When the air conditioner 10 is under cooling operation, the outdoor heat exchanger 13 functions as a condenser, and the indoor heat exchanger 11 functions as an evaporator. When the air conditioner 10 is under heating operation, the outdoor heat exchanger 13 functions as an evaporator, and the indoor heat exchanger 11 functions as a condenser.

The outdoor fan casing 23 is disposed so as to be connected t the outdoor heat exchanger 13, and the propeller fan 14 is disposed inside the outdoor fan casing 23. The propeller fan 14 is rotated by an outdoor driving motor 25, and the outdoor driving motor 25 is supported on the support leg 24 The outdoor-side chamber 22 is partitioned into an outdoor discharge chamber at the inside of the outdoor fan casing 23 and an outdoor suction chamber 27 at the outside of the outdoor fan casing 23 by the outdoor fan casing 23.

By rotation of the propeller fan 14, the outside air is sucked from the outdoor suction ports 28A, 28B at both the sides of the outdoor heat exchanger 13 into the outdoor suction chamber 27 as shown by arrows A of FIG. 4, passed through the a fan orifice 29 of the outdoor fan casing 23 and then discharged into the outdoor discharge chamber 26. Thereafter, the outside air is passed through the outdoor heat exchanger 13 and then discharged from the outdoor discharge port 30 to the outside. Under the cooling operation of the air conditioner 10, the outdoor heat exchanger 13 discharge heat to the outside air, and under the heating operation of the air conditioner 10, the outdoor heat exchanger 13 takes heat from the outside air.

As shown in FIG. 3, each vane of the propeller fan 14 is equipped with a slinger ring on the outer peripheral portion thereof to link the vanes to one another. Under the cooling operation of the air conditioner 10, drain water occurs on the indoor heat exchanger 11 serving as the evaporator. The drain water is collected in a drain pan 33 as described later, and then it is passed through a drain opening 44 formed at the lower end portion of the partition plate 20 and stocked into a reservoir portion 32 disposed on the bottom plate 16. The slinger ring 31 drains up the drain water stocked in the reservoir portion 32 when the propeller fan 14 is rotated, and the drain water thus drained up is scattered to the outdoor heat exchanger 13 functioning as the condenser, whereby the condensation function of the outdoor heat exchanger is enhanced.

The drain pan 33 is disposed at the indoor-side chamber side on the bottom plate 16, and the indoor heat exchanger 11 is disposed on the drain pan 33. The partition plate 20 is designed in a box-shape having an opening at the indoor-side chamber side, and an indoor fan casing 34 is disposed inside the partition plate 20.

The indoor fan casing 34 is curved from the position corresponding to a first top panel 41 (described later) of the partition plate 20 so as to extend to the drain pan 33, and an electrical heater 55 is disposed at the lower end portion of the indoor fan casing 34 so as to be adjacent to the indoor heat exchanger 11. A cross-flow fan 12 is disposed at the inside of the curved indoor fan casing. Accordingly, the indoor fan casing 34 is disposed between the partition plate 20 and the cross-flow fan 12.

The cross-flow fan 12 is rotated by an indoor driving motor 35 shown in FIG. 4, and the cross-flow fan 12 and the indoor driving motor 35 are supported on the partition plate 20. The indoor fan casing 34 forms an indoor circulating chamber 36 and an outside air introducing chamber 37 at the indoor-side chamber side as shown in FIG. 3. Further, as shown in FIG. 4, an electrical-equipment chamber 46 in which an electrical-equipment ox 45 is accommodated is formed at the indoor-side chamber side.

The indoor heat exchanger 11, the cross-flow fan 12 and the electrical heater 55 are disposed in the indoor circulating chamber 36 as shown in FIG. 3. Further, an air filter 38 and a stabilizer 39 are disposed in the indoor circulating chamber 36. The air filter 38 is disposed between a suction grille 40 formed in a front panel 18 and the indoor heat exchanger 11. The stabilizer 39 is disposed at the upper side of the indoor heat exchanger 11 so as to extend to the cross-flow fan 12. The stabilizer 39 enables the air in the indoor circulating chamber 36 to be excellently sucked into the cross-flow fan 12, and the air thus sucked can be excellently discharged from the cross-flow fan 12. A blow-out grille 43 for guiding the discharged air into the room of the building is formed at the upper side of the suction grille 40 on the front panel 18.

The air in the room of the building is taken from the suction grille 40 into the indoor circulating chamber 36 of the indoor-side chamber 21 by the rotation of the cross-flow fan 12. The air thus taken is passed through the air filter 38, the indoor heat exchanger 11 and the electrical heater 55 in this order, and then sucked into the cross-flow fan 12. Thereafter, the air is discharged from the cross-flow fan 12, and blown out from the blow-out grille 43 into the room. Under the cooling operation of the air conditioner 10, the indoor heat exchanger 11 cools the indoor air taken in the indoor circulating chamber 36 to cool the inside of the room. Under the heating operation, the indoor air is heated to heat the inside of the room.

The outside air introducing chamber 37 is one of constituent elements constituting a ventilation device for taking the outside air from the outdoor-side chamber 22 into the indoor circulating chamber 36 of the indoor-side chamber 21, whereby fresh air can be supplied into the room of the building. The ventilation device 47 is constructed by ventilation ports 48, a ventilation shutter 49 and a ventilation aeration portion 50A in addition to the outside air introducing chamber 37.

Figure 5:
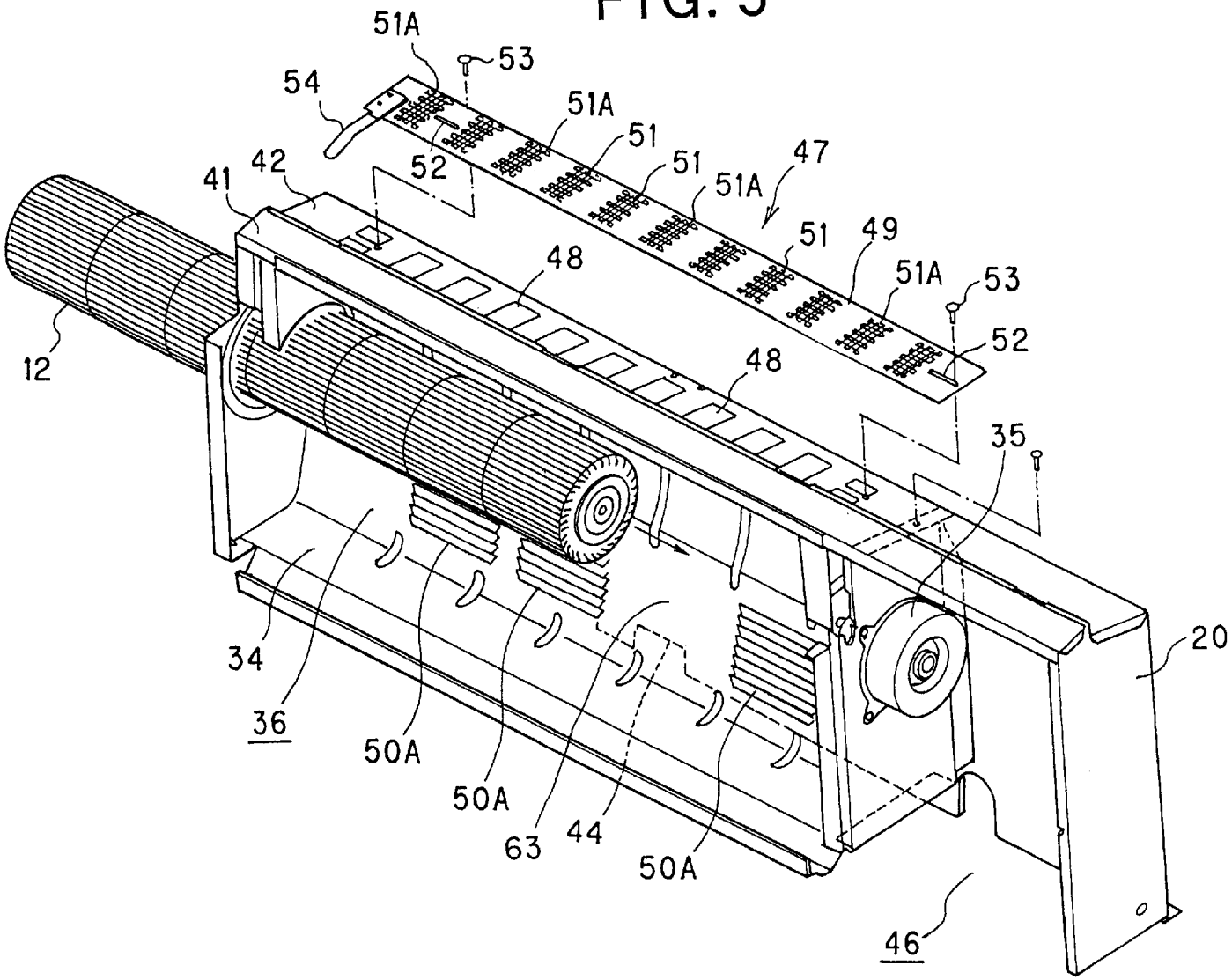
FIG. 5 is an exploded perspective view showing a partition plate, a cross-flow fan, a ventilation device, etc. of FIG. 2.

A second top panel 42 is formed at the lower position than the first top panel 41 on the box-shaped partition plate 20 so as to intercommunicate with the first top panel 41. The second top panel 42 is disposed inside the cabinet 19 compartmenting the surrounding of the outdoor-side chamber 22. As shown in FIGS. 4 and 5, a plurality of ventilation ports 48 are formed in the second top panel 42 to be juxtaposed with one another at the same pitch in the longitudinal direction of the second top panel 42.

A ventilation shutter 49 having many fine holes 51 formed therein is mounted on the second top panel 42. These fine holes 51 are gathered every group, and plural fine-hole groups 51A are arranged at the same pitch in the longitudinal direction of the ventilation shutter 49. The pitch of the fine-hole groups 51A is set to substantially the same pitch as the ventilation ports 48 of the second top panel 42.

Elongated holes 52 extending in the longitudinal direction of the ventilation shutter 49 are formed at both the end portions of the ventilation shutter 49. The ventilation shutter 49 is fixed to the second top panel 42 of the partition plate 20 through screws penetrating through the elongated holes 52 so as to be freely slidable in the longitudinal direction of the second top panel 42 and the ventilation shutter 49.

Figure 6:
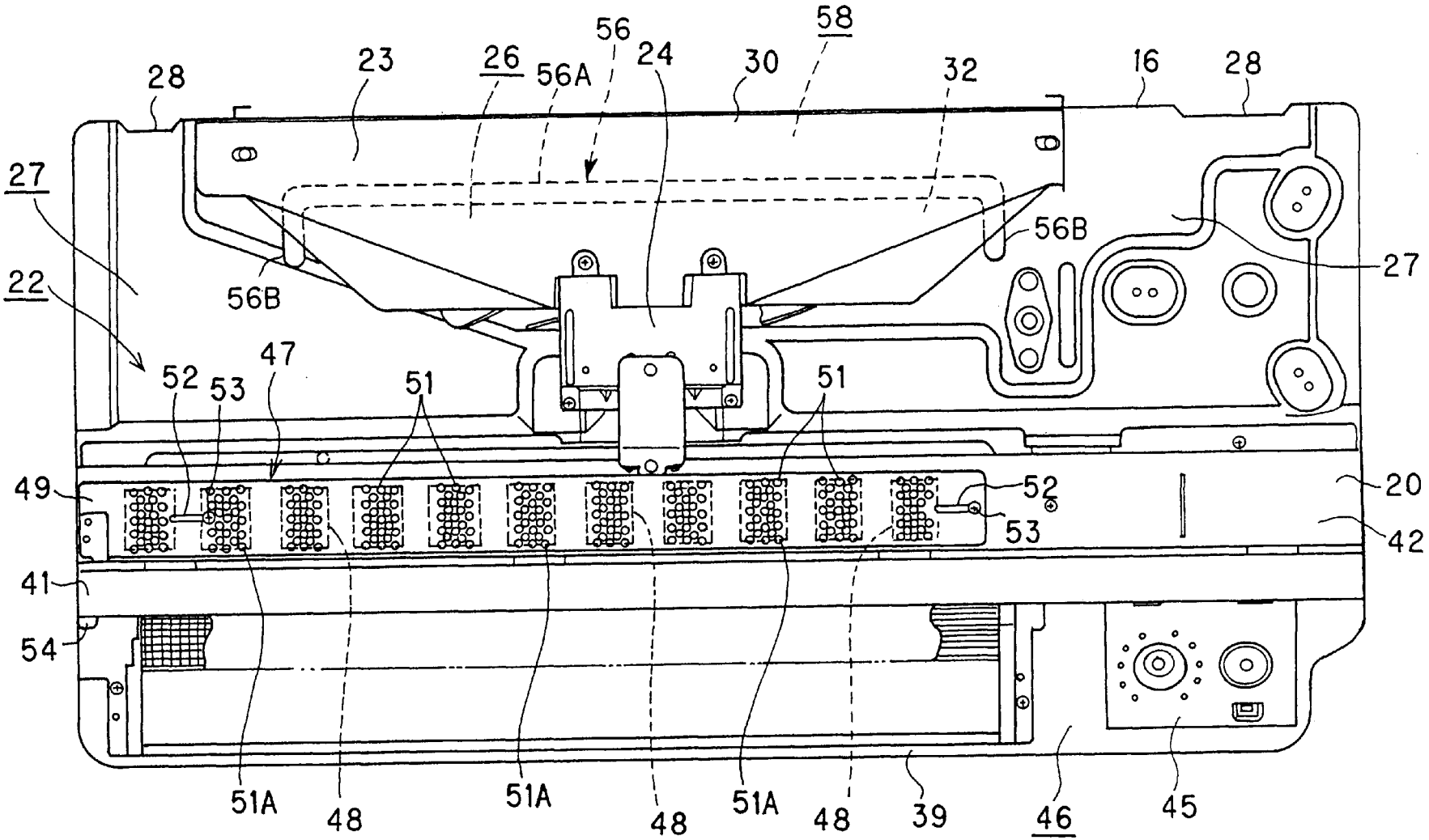
FIG. 6 is a plan view corresponding to FIG. 4, which shows a fabrication state of the ventilation device, etc. of FIG. 5.

As shown in FIG. 6, when the fine-hole groups 51A of the ventilation shutter 49 are positionally coincident with the ventilation ports 48 by sliding the ventilation shutter 49, the ventilation ports 48 are fully opened. On the other hand, when the fine-hole groups 51A are not positionally coincident with the ventilation ports 48 and the ventilation shutter 49 closes the ventilation ports 48, the ventilation ports 48 are fully closed. Further, by sliding the ventilation shutter 49 to any position between the full-open position and the full-close position, the opening degree of the ventilation ports 48 can be freely adjusted to any intermediate value between the full-open value and the full-close value, such as a half-open value, a second-thirds open value or the like. Through the opening operation of the ventilation ports 48, the outside air flowing into the outdoor-side chamber 22 is guided by the cabinet 19 to pass through the fine holes 51 of the ventilation shutter 49 and the ventilation ports 48 of the second top panel 42, and then introduced into the outside introducing chamber 37.

Here, the ventilation ports 48 are designed to be inclined downwardly to the outdoor-side chamber 22, whereby the fluid flow area of the outside air between the second top panel 42 and the cabinet 19 is more greatly enlarged as compared with the case where the ventilation ports 48 are designed to be horizontal. Further, each of the fine holes 51 of the ventilation shutter shown in FIG. 6 is formed to have a remarkably smaller diameter than the opening area of the ventilation ports 48, whereby the diameter of each fine hole 51 is set to such a value that it functions as an air filter to prevent invasion of insects, dust, etc.

The ventilation aeration portion 50A is equipped with plural vent ports 50 at the lower portion of the indoor fan casing 34 as shown in FIG. 5. The vent ports 50 are formed in a louver-shape so as to be juxtaposed with one another by cutting the lower portion of the indoor fan casing 34 into plural pieces and erecting the pieces thus achieved as shown in FIG. 5. A plurality of ventilation aeration portions 50A as described above are formed in the longitudinal direction of the indoor fan casing 34 except for the position corresponding to the drain opening 44 of the partition plate 20.

When the cross-flow fan 12 is rotated, the space below the cross-flow fan 12 in the indoor circulating chamber 36, that is, the space in the neighborhood of the ventilation aeration portions 50A is kept under negative pressure as shown in FIG. 3. Therefore, as indicated by arrows C of FIG. 3, the outside air introduced through the fine holes 51 of the ventilation shutter 49 and the ventilation ports 48 of the second top panel 42 into the outside air introducing chamber 37 downwardly flows along the outside of the curved indoor fan casing 34, passes through the aeration ports 50 of the plural ventilation aeration portions 50A and then is guided into the indoor circulating chamber 36. The outside air thus guided into the indoor circulating chamber 36 is mixed with the indoor air air-conditioned by the indoor heat exchanger 11, and introduced from the blow-out grille 43 of the front panel 18 into the room of the building, whereby fresh air is supplied into the room.

As shown in FIG. 5, an operating lever 54 is integrally linked to one end portion of the ventilation shutter 49. The operating lever 54 is disposed so as to extend to the indoor heat exchanger 11 as shown in FIGS. 2 and 6 so that it can be manipulated when the front panel 18 is detached from the main body of the air conditioner or the like. By manipulating the operating lever horizontally, the ventilation shutter 40 is directly slid to any position with no wire, whereby the opening degree of the ventilation ports 48 can be adjusted to any value such as the full-open value, the full-close value, the half-open value, etc.

Figure 8:
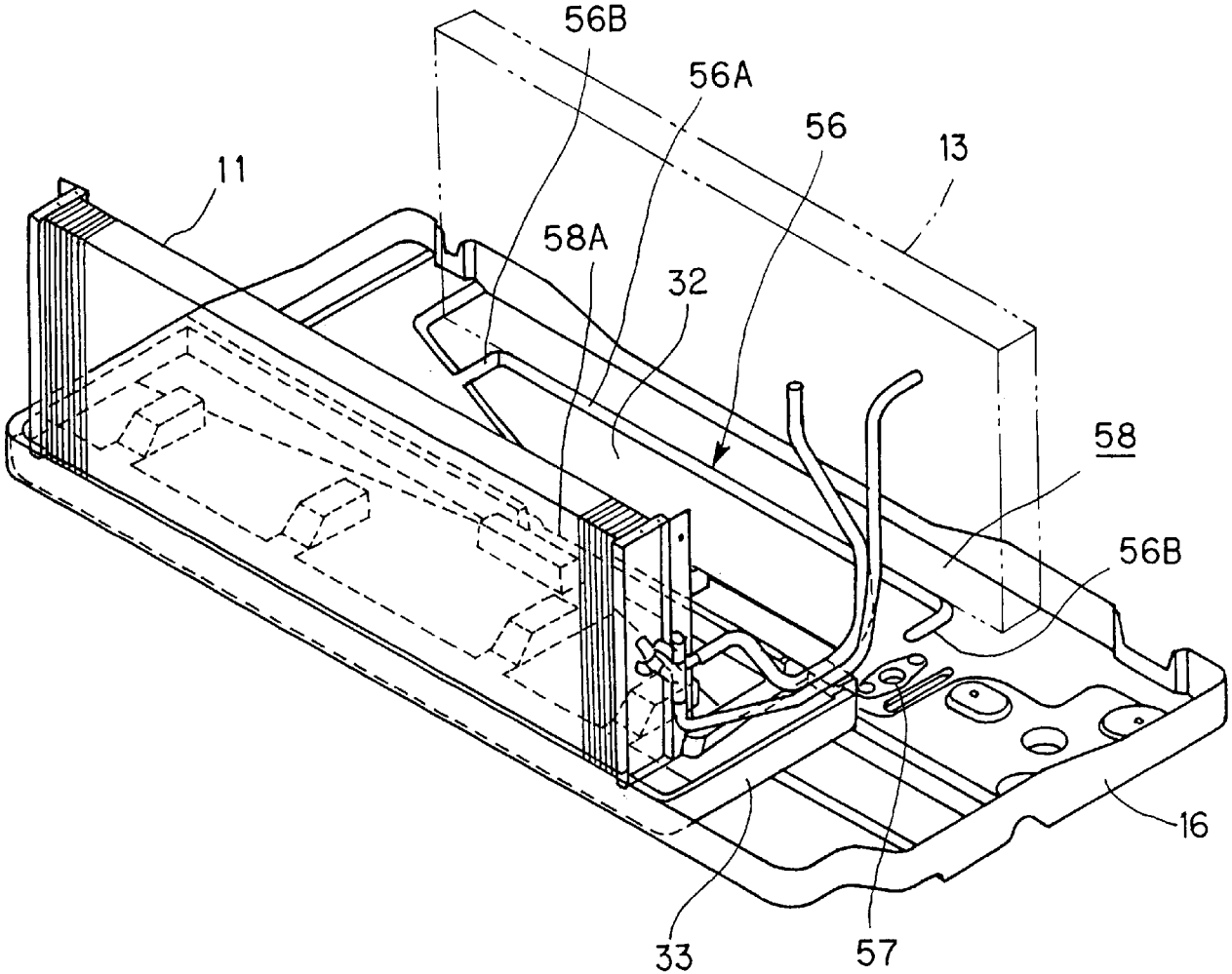
FIG. 8 is a perspective view showing a fabrication state of the bottom plate, the drain pan, an indoor heat exchanger and an outdoor heat exchanger.

In the outdoor-side chamber, the outdoor heat exchanger 13 is disposed on the bottom plate 16 on which the partition plate is erectly provided as shown in FIG. 3. The bottom plate 16 is formed of a drawing member which has high malleability and is easily expandable. A dam member 56 for damming stream of drain water is integrally formed on the bottom plate 16 so as to be located in the neighborhood of the outdoor heat exchanger 13 by a drawing processing as shown in FIG. 8.

Figure 7:
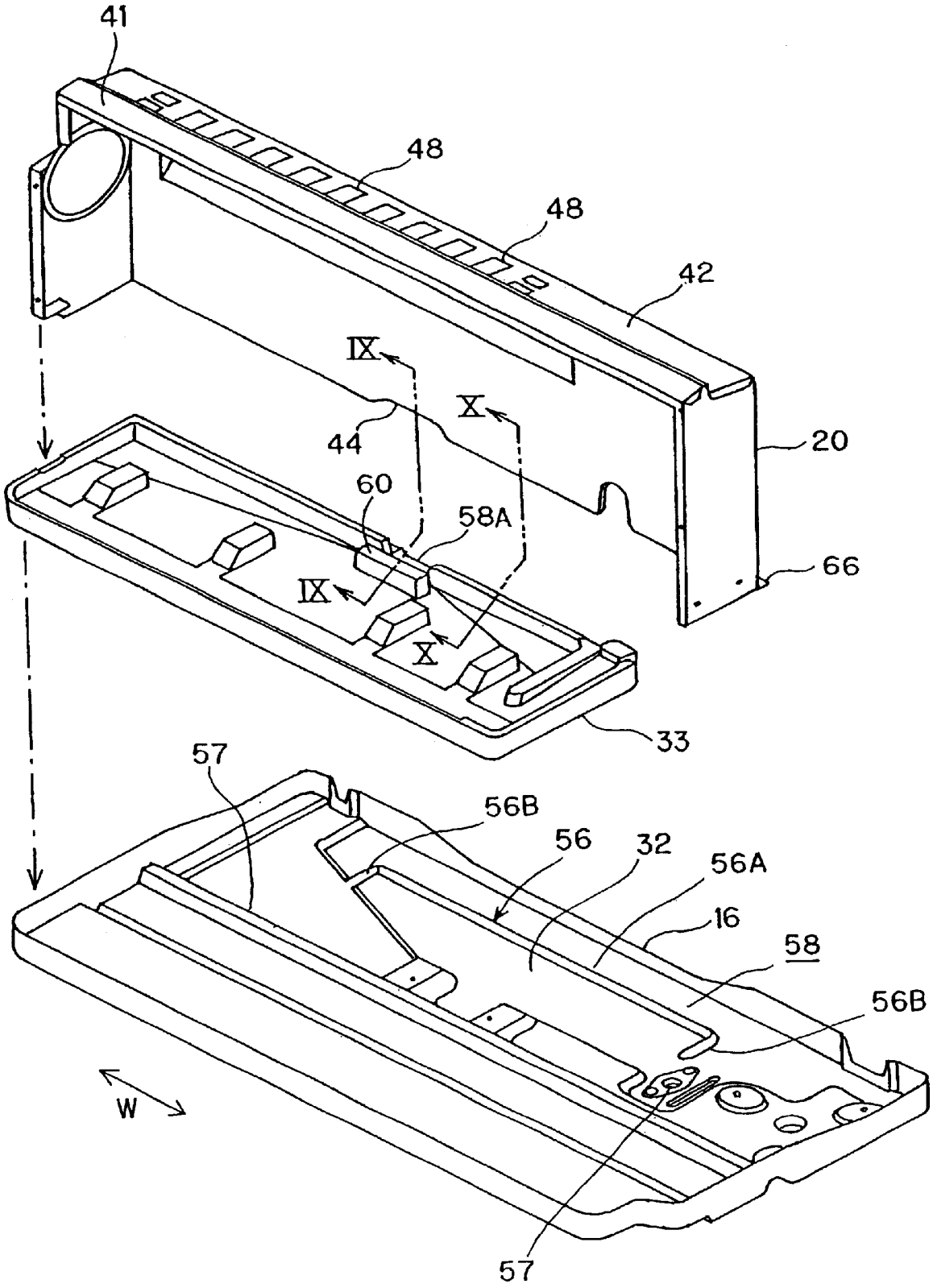
FIG. 7 is an exploded perspective view showing a bottom plate, a drain pan and a partition plate of FIG. 2.

As shown in FIG. 7, the dam member 56 is designed substantially in U-shape so that the center portion 56A thereof extends in the width (W) direction of the bottom plate 16 and both the ends 56B extend in the direction to the indoor-side chamber 21. The inside of the dam member 56 forms the reservoir portion 32 in which the drain water can be stocked.

Under the cooling operation of the air conditioner, the indoor heat exchanger 11 functions as an evaporator and the outdoor heat exchanger 13 functions as a condenser as shown in FIG. 3. Drain water generated by the indoor heat exchanger 11 passes through the drain pan 33 and the drain opening 44 of the partition plate 20, flows down to the outdoor-side chamber side of the bottom plate 16, and then is stocked in the reservoir portion 32. Extra drain water overflowing from the reservoir portion 32 is discharged from a drain port 57 (FIG. 7) to the outside. The drain water stocked in the reservoir portion 32 is drained up by rotation of a slinger ring 31 of an outdoor fan (propeller fan) 14 and scattered and attached to the outdoor heat exchanger. The drain water attached to the outdoor heat exchanger 13 is vaporized to enhance the condensation capability of the outdoor heat exchanger 13.

Under the heating operation of the air conditioner 10, the indoor heat exchanger functions as a condenser and the outdoor heat exchanger 13 functions as an evaporator. As shown in FIG. 8, drain water generated by the outdoor heat exchanger 13 is stocked at an outside area 58 of the dam member 56 of the bottom plate 16 on which the outdoor heat exchanger 13 is mounted, and prevented from flowing into the reservoir portion 32 inside the dam member 56 by the dam member 56. If the drain water generated by the outdoor heat exchanger 13 flows into the reservoir portion 32, the drain water may be frozen, so that there is a risk that the frozen drain water collides against the slinger ring 31 of the propeller fan 14 to generate abnormal noise. In order to prevent occurrence of such abnormal noise, the dam member 56 serves to prevent the drain water generated by the outdoor heat exchanger 13 from flowing into the reservoir portion 32.

As shown in FIGS. 3 and 6, the dam member 56 is disposed so that the outdoor fan casing 23 abuts against both the end portions 56B of the dam member 56. Accordingly, the outdoor fan casing 23 is excellently supported on the bottom plate 16 through the dam member 56.

According to the above-described embodiment, the following effects (1) to (4) can be achieved.

(1) The dam member 56 for damming flow of drain water is integrally formed on the bottom plate 16 on which the outdoor heat exchanger 13 is disposed so that the dam member 56 is located in the neighborhood of the outdoor heat exchanger 13. Therefore, the manufacturing cost of the bottom plate 16 can be reduced as compared with the case where the dam member 56 is manufactured as a separate part from the bottom plate 16, the separate part (dam member 56) thus manufactured is fixed to the bottom plate 16 and then a sealing treatment is conducted on the dam member 56 and the bottom plate 16.

(2) Since the dam member 56 is integrally formed on the bottom plate 16 by the drawing processing, the dam member 56 can enhance the mechanical strength of the bottom plate 16.

(3) The dam member 56 is designed substantially in U-shape so that the center portion 56A thereof extends in the width W direction of the bottom plate 16. Therefore, when the outdoor heat exchanger 13 functions as a condenser, drain water is stocked in the reservoir portion 32 inside the dam member 56, and the drain water is scattered to the condenser by rotation of the slinger ring 31 of the propeller fan 14 to enhance the condensation capability. Further, when the outdoor heat exchanger 13 functions as an evaporator, the drain water generated by the evaporator can be prevented from flowing into the reservoir portion 32 inside the dam member 56. Therefore, there can be avoided such a problem that the drain water is frozen in the reservoir portion 32 and collide against the slinger ring 31.

(4) The outdoor fan casing 23 in which the propeller fan 14 is accommodated abuts against the dam member 56 of the bottom plate 16, so that the outdoor fan casing 23 can be supported on the bottom plate 16 through the dam member 56 and thus the outdoor fan casing 23 can be more surely supported on the bottom plate 16.

Figure 10:
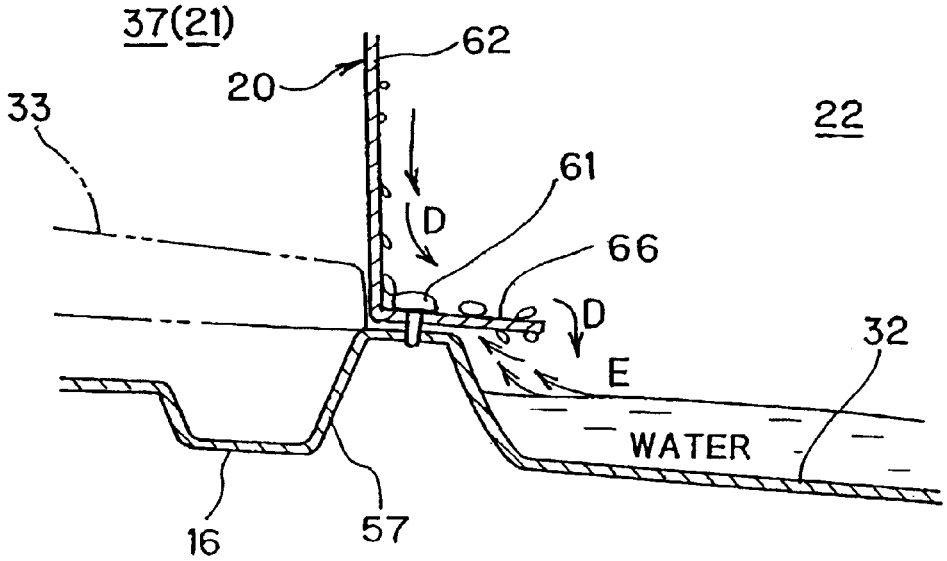
FIG. 10 is a cross-sectional view taken along X—X line of FIG. 7.

As shown in FIGS. 7 and 10, a fixing flange portion 66 which is bent in an L-shape and extends in the direction to the outdoor-side chamber 22 is formed at the lower end of the partition plate 20. A projecting portion 57 extending linearly in the longitudinal direction of the partition plate 20 is integrally formed on the bottom plate 16 by the drawing processing or the like. As shown in FIG. 10, the fixing flange portion 66 of the partition plate 20 is fixed to the projecting portion 57 by screws 61 or the like under the state that the fixing flange portion 66 extends from the projecting portion 57 in the direction to the outdoor-side chamber 22, whereby the partition plate 20 is erectly mounted on the bottom plate 16. Accordingly, even when under a terrible storm such as a hurricane or the like, rain water passes through the outdoor-side chamber 22 and flows down while attached to a surface 62 of the partition plate 20 which faces the outdoor-side chamber 22 as indicated by an arrow D of FIG. 10, the rain water flows down from the tip of the fixing flange portion 66 extending in the direction to the outdoor-side chamber 22 to the bottom plate 16 at the outdoor-side chamber (22) side. Therefore, the rainwater is prevented from passing through the gap between the fixing flange portion 66 and the projecting portion 57 of the bottom plate 16 and invading into the indoor-side chamber 21.

Further, the fixing flange portion 66 of the partition plate 20 is designed to further extend in the direction to the outdoor-side chamber 22 as compared with the projecting portion 57 of the bottom plate 16. Therefore, even when drain water stocked in the outdoor-side chamber 22 of the bottom plate 16 is agitated by the wind of terrible storm such as hurricane or the like and invades over the projecting portion 57 of the bottom plate 16 into the indoor-side chamber 21, the invasion of the drain water is prevented by the fixing flange portion 66 of the partition plate 20.

Further, the drain opening 44 described above is formed at the center portion in the longitudinal direction of the lower end of the partition plate 20 as shown in FIG. 7. At the lower end of the partition plate 20, the fixing flange portion 66 is not formed at the position corresponding to the drain opening 44.

Figure 9:
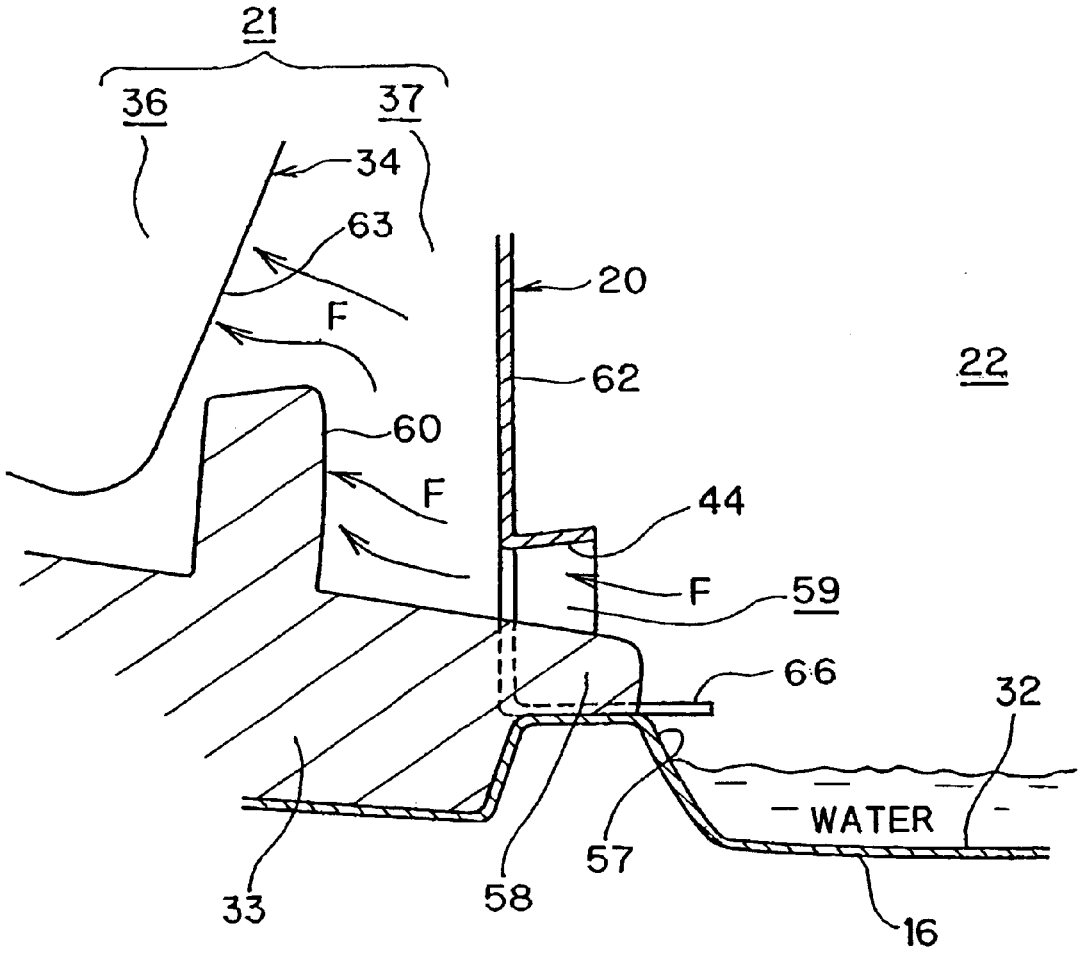
FIG. 9 is a cross-sectional view taken along IX—IX line of FIG. 7, which shows an enlarged IX portion of FIG. 3.

As shown in FIG. 8, the drain pan 33 mounted on the bottom plate 16 is integrally formed with a drain tag portion 58A which is inserted into the drain opening 44 of the partition plate 20 under the condition that the partition plate 20 and the drain pan 33 are mounted on the bottom plate 16. As shown in FIG. 9, the drain tag portion 58A and the drain opening 44 form a drain flow channel through which the drain water flows from the drain pan 33 into the reservoir portion 32 of the bottom plate 16.

Further, the drain pan 33 is integrally formed with a projecting portion 60 at the position confronting to the drain opening 44 of the partition plate 20, that is, at the position corresponding to the drain tag portion 58A in the outside air introducing chamber 37. The position and dimension of the projecting portion 60 are determined so that when rainstorm of hurricane or the like invades through the drain flow channel 59 as indicated by arrows F of FIG. 9, the rainstorm can be prevented by the projecting portion 60.

As shown in FIG. 3, plural ventilation aeration portions 50A are formed in the indoor fan casing 34 through which the indoor-side chamber 21 is compartmented into the outside air introducing chamber 37 and the indoor circulating chamber 36. As shown in FIG. 5, no ventilation aeration portion 50A is formed at the portion corresponding to the drain opening 44 of the partition plate 20 and the projecting portion 60 of the drain pan 33, and this portion is set as a rain/wind collision portion 63.

Accordingly, rainstorm of hurricane or the like passes through the drain flow channel 59 and invades into the outside air introducing chamber 37 of the indoor-side chamber 21, and collides against the projecting portion 60 of the drain pan 33. Thereafter, the rainstorm collides against the rain/wind collision portion 63 of the indoor fan casing 34 without colliding the projecting portion 60 again. Accordingly, the rainstorm is dammed up by the rain/wind collision portion 63, and it can be surely prevented from invading into the indoor circulating chamber 36.

As described above, the rain water invasion preventing mechanism is constructed by the fixing flange portion 66 of the partition plate 20, the projecting portion 57 of the bottom plate 16, the projecting portion 60 of the drain pan 33 and the rain/wind collision portion 63 of the indoor fan casing 34, and thus the following effects (1) to (4) can be achieved.

(1) The drain pan 33 which is mounted in the indoor-side chamber 21 and on which the indoor heat exchanger 11 is mounted is provided with the projecting portion 60 so that the projecting portion 60 faces the drain opening 44 formed in the partition plate 20 through which the indoor-side chamber 21 and the outdoor-side chamber 22 are partitioned. Therefore, even when rainstorm of hurricane or the like passes through the drain flow channel 59 formed by the drain opening 44, etc. and then invades into the outside air introducing chamber 37 of the indoor-side chamber 21, the invasion can be prevented by the projecting portion 60. As a result, the rainstorm can be prevented from passing through the indoor-side chamber 21 of the air conditioner 10 and invading into the room.

(2) The indoor fan casing 34 is disposed between the cross-flow fan 12 and the partition plate 20 in the indoor-side chamber 21 of the air conditioner 10 and rainstorm is made to collide against the rain/wind colliding portion 63 of the indoor fan casing 34. Therefore, even when rainstorm which passes through the drain flow channel 59 formed by the drain opening 44, etc. of the partition plate 20 and invades into the outside air introducing chamber 37 of the indoor-side chamber 21 does not collide against the projecting portion 60 of the drain pan 33 or it collides against the projecting portion 60, but its power is not attenuated, the rainstorm can be dammed up by the rain/wind colliding portion 63 of the indoor fan casing 34. As a result, rainstorm can be surely prevented from passing through the indoor-side chamber 21 of the air conditioner 10 and invading into the room.

(3) The fixing flange portion 66 of the partition plate 20 is fixed to the projecting portion 57 under the condition that it extends from the projecting portion 57 of the bottom plate 16 in the direction to the outdoor-side chamber 22. Therefore, even when rainstorm collides against the partition plate 20 and rain water attaches to the surface 62 of the partition plate 20 which confronts the outdoor-side chamber 22, the rain water flows down from the tip of the fixing flange portion 66 to the outdoor-side chamber side of the bottom plate 16. Therefore, the rain water can be prevented from leaking to the indoor-side chamber 21. As a result, rainstorm (particularly rain water) can be prevented from passing through the indoor-side chamber 21 of the air conditioner 10 and invading into the room.

(4) The fixing flange portion 66 of the partition plate 20 is designed to further extend to the outdoor-side chamber side as compared with the projecting portion 57 of the bottom plate 16, Therefore, even when drain water stocked on the bottom plate 16 is agitated by rainstorm of hurricane or the like, it is dammed up by the fixing flange portion 66, and thus rainstorm can be prevented from passing over the projecting portion 57 and invading through the gap between the projecting portion 57 and the fixing flange portion 66 into the indoor-side chamber 21.

The present invention is not limited to the above-described embodiments, and various modifications may be made without departing from the subject mater of the present invention.

According to the present invention, the manufacturing cost of the bottom plate can be reduced. Further, rain/wind under rainstorm or the like can be prevented from invading into the room.

What is claimed is:

1. The air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate mounted on a bottom plate, characterized in that said outdoor heat exchanger is disposed on said bottom plate, and said bottom plate is integrally formed with a dam member for damming up drain water flowing from at least one of said indoor heat exchanger and said outdoor heat exchanger, wherein said dam member is disposed in the neighborhood of said outdoor heat exchanger.

2. The air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate mounted on a bottom plate, characterized in that said outdoor heat exchanger is disposed on said bottom plate, and said bottom plate is integrally formed with a dam member for damming up drain water flowing from at least one of said indoor heat exchanger and said outdoor heat exchanger, further comprising a fan casing in which said outdoor fan is accommodated, wherein said dam member is disposed so as to abut against said fan casing.

3. The air conditioner as claimed in claim 2, wherein said bottom plate is formed of a drawing member having high malleability, and said dam member is integrally formed on said bottom plate by drawing processing.

4. The air conditioner as claimed in claim 2, wherein said dam member is designed substantially in U-shape so that the center portion thereof extends in the width direction of said bottom plate.

5. An air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate mounted on a bottom plate, characterized in that a drain pan on which said indoor heat exchanger is mounted is disposed on said bottom plate, said partition plate is equipped with a drain opening through which drain water flowing from said indoor heat exchanger through said drain pan is flows to said bottom plate, and at least one of said drain pan and said partition plate is equipped with an intercepting member for intercepting flow of rain/wind from said outdoor-side chamber to said indoor-side chamber.

6. The air conditioner as claimed in claim 5, wherein said intercepting member is a projecting portion that is erectly equipped on said drain pan so as to face said drain opening.

7. The air conditioner as claimed in claim 5, wherein said intercepting member is a flange portion that is formed at the lower end portion of said partition plate so as to extend to said outdoor-side chamber.

8. The air conditioner as claimed in claim 7, wherein said flange portion is fixed to said bottom plate to thereby fix said partition plate to said bottom plate.

9. The air conditioner as claimed in claim 7, wherein said bottom plate is equipped with a projecting portion extending in the longitudinal direction of said partition plate, and said flange portion of said partition plate is fixed to said projecting portion of said bottom plate while said flange portion extends from said projecting portion to said outdoor-side chamber.

10. The air conditioner as claimed in claim 5, further comprising an indoor fan casing in which said indoor fan is accommodated, wherein said indoor fan casing is disposed between said indoor fan and said partition plate so that flow of rain/wind from said outdoor-side chamber to said indoor-side chamber is intercepted by said indoor fan casing.

* * * * *

UNITED STATES PATENT AND TRADEMARK OFFICE

CERTIFICATE OF CORRECTION

PATENT NO. : 6,701,737 B2
DATED : March 9, 2004
INVENTOR(S) : Yasunori Ohama et al.

It is certified that error appears in the above-identified patent and that said Letters Patent is hereby corrected as shown below:

Title page,
Item [73], Assignee, delete "Sanyo Electric Air Conditioning" and substitute -- Sanyo Electric Air Conditioning Co., Ltd. --.

Signed and Sealed this

Thirteenth Day of July, 2004

JON W. DUDAS
*Acting Director of the United States Patent and Trademark Office*